US006854491B1

(12) United States Patent
Knight et al.

(10) Patent No.: US 6,854,491 B1
(45) Date of Patent: Feb. 15, 2005

(54) LOW SURFACE ENERGY FUEL NOZZLE

(75) Inventors: Paul A. Knight, Spokane, WA (US); Walt D. Takisaki, Spokane, WA (US)

(73) Assignee: KnuBox Technologies, Spokane, WA (US)

( * ) Notice: Subject to any disclaimer, the term of this patent is extended or adjusted under 35 U.S.C. 154(b) by 0 days.

(21) Appl. No.: 10/693,183

(22) Filed: Oct. 24, 2003

(51) Int. Cl.[7] ..... B65B 1/04
(52) U.S. Cl. ..... 141/59; 141/392; 141/206
(58) Field of Search ..... 141/392, 59, 206–229

(56) References Cited

U.S. PATENT DOCUMENTS

| | | | | |
|---|---|---|---|---|
| 2,686,626 | A | * 8/1954 | Slattery | 141/207 |
| 3,739,988 | A | 6/1973 | Kisor et al. | |
| 4,005,339 | A | 1/1977 | Plantard | |
| 4,213,488 | A | 7/1980 | Pyle | |
| 4,351,375 | A | 9/1982 | Polson | |
| 4,453,578 | A | 6/1984 | Wilder | |
| 4,682,714 | A | 7/1987 | Wood | |
| 5,004,023 | A | 4/1991 | Monticup, Jr. et al. | |
| 5,007,468 | A | 4/1991 | Wilder et al. | |
| 5,213,142 | A | 5/1993 | Koch et al. | |
| 5,255,723 | A | 10/1993 | Carmack et al. | |
| 5,267,670 | A | * 12/1993 | Foster | 222/1 |
| 5,450,884 | A | 9/1995 | Shih et al. | |
| 5,603,364 | A | 2/1997 | Kerssies | |
| 5,620,032 | A | 4/1997 | Dame | |
| 5,645,116 | A | 7/1997 | McDonald | |
| 5,765,609 | A | 6/1998 | Dalhart et al. | |
| 5,832,970 | A | 11/1998 | Carow | |
| 6,126,047 | A | 10/2000 | Johnson et al. | |
| 6,311,742 | B1 | 11/2001 | Nusen et al. | |
| 6,520,222 | B2 | 2/2003 | Carmack et al. | |

* cited by examiner

*Primary Examiner*—Steven O. Douglas
(74) *Attorney, Agent, or Firm*—Paul A. Knight

(57) ABSTRACT

A low liquid retention fuel nozzle that is mainly comprised of a nozzle body and a spout attached to the nozzle body. A fuel supply travels down the nozzle body and through the spout and into a container. Typically, after the flow of fuel is stopped within a nozzle, fuel drips from the spout and resides on its surfaces. Nozzle spouts are typically made from aluminum which is easily wet-out by fuels which facilitates the creation of drips and residual fuel. The present invention is directed towards a spout with one or more surfaces that have a low surface energy. The low surface energy promotes drops to form. The resulting drops are likely to fall into the container to be filled prior to the user removing the spout from the container. The result is less contaminating fuel drops on the ground and less environmentally polluting fuel vapors reaching the atmosphere.

23 Claims, 5 Drawing Sheets

LOW SURFACE ENERGY FUEL NOZZLE

REFERENCE TO RELATED APPLICATION

There no related applications.

STATEMENT REGARDING FEDERALLY SPONSORED R&D

Not applicable to this application.

TECHNICAL FIELD

This invention relates to a fuel nozzle and more particularly to a fuel dispensing nozzle that reduces the amount of residual fuel on the spout after an operating cycle.

BACKGROUND OF THE INVENTION

Fuel dispensing nozzles are widely used and understood in the field. Early fuel nozzles are mainly comprised of a manual actuated valve and a metallic spout for directing fuel into a desired container. Many improvements have been made to fuel nozzles, including U.S. Pat. No. 4,453,578, which provide the means of automatically stopping fuel flow when the fuel reaches a desired level.

In addition, many design improvements have been made regarding nozzle spouts. U.S. Pat. No. 5,765,609 describes a method for manufacturing an aluminum spout that removably attaches to a nozzle body. Removable spouts enable them be replaced in shorter intervals than the more expensive nozzle body. Replacing a spout may be desirable when a nozzle is left in a motor vehicle after drive-away, upon considerable wear, or as improved spouts become available.

Recently, significant attention has been directed to the adverse environmental effects caused by fuel dispensing nozzles. One such effect is caused by fuel vapors displaced from a container as heavier liquid fuel is dispensed into the container. The displaced vapors contain volatile organics that chemically react with nitrogen oxides to form ground level ozone, often called "smog". Ground level ozone can potentially cause irritation to the nose, throat, lungs and bring on asthma attacks. In addition, gasoline vapors are suspected to contain other harmful toxic chemicals, such as benzene.

In an effort to reduce the amount of harmful vapors that reach the atmosphere, a vapor recovery nozzle has been developed; one version of the spout is best described by U.S. Pat. No. 4,351,375. This version of a vapor recovery nozzle is comprised of a coaxial tube that both dispense fuel through a main tube and vacuum vapors through a secondary channel. A large percentage of the captured vapors are treated and safely released in the atmosphere. Vapor recovery systems are required by the laws of many states, especially at high volume stations or stations located in densely populated areas. California's Air Resource Board (CARB) is largely responsible for setting forth new standards for fuel dispensing nozzles.

Although vapor recovery has significantly reduced the amount of volatile organics that reach the atmosphere during fueling, there are several other sources of fuel vapors that contribute to the problem of "smog". One such source is fuel dripped from a nozzle spout after fueling. Typically, when a nozzle is deactivated there is a delay before the user removes the nozzle spout from the container to be filled. If the delay is sufficient, drops from the spout will fall into the container. If the delay is insufficient, drops fall onto the ground or the local filling equipment. Spilt fuel evaporates into the atmosphere and contaminates the ground. Even waiting a significant amount of time before removing the nozzle will not ensure that drips will not occur. Some users try to supplement waiting by tapping the nozzle spout on the fill tube of the container prior to removing it.

Another source of "smog" is caused by fuel residing on the nozzle after fueling. Residual fuel is caused by adhesive forces between the nozzle surfaces and the fuel. Fuel can reside on both the inside and outside surfaces of a spout. As with dripping, residual fuel evaporates into the atmosphere.

In an effort to reduce sources of "smog" not directly addressed through vapor recovery, many new nozzle requirements and laws have been implemented. Many new nozzle designs are directed towards the goals of further reducing fuel vapor sources, such as U.S. Pat. No. 6,520,222, U.S. Pat. No. 5,603,364, U.S. Pat. No. 4,213,488, U.S. Pat. No. 5,645,116, and U.S. Pat. No. 5,620,032. Although the aforementioned patents may potentially serve in the direction of their intended purposes, most are unlikely to reliably provide true "dripless" performance. None of the aforementioned patents address the issue of residual fuel on the outside surface of a nozzle, caused by splashing. Many of the aforementioned patents are not compatible with both, standard type nozzles and vapor recovery type systems. Many of the aforementioned patents require substantial change over costs.

In these respects, the low surface-energy, fuel-dispensing nozzle according to the present invention substantially departs from conventional concepts of the prior art, and in doing so provides an apparatus primarily designed for the purpose of reducing the amount of vapor that reaches the atmosphere during a fueling cycle.

SUMMARY OF THE INVENTION

The present invention therefore aims at providing a nozzle that reduces the amount of residual fuel on the spout after a fueling cycle is completed. In addition, the present invention aims at reducing the number of drips that occur after the nozzle is removed from a container. The present invention is comprised of a fuel dispensing nozzle housing a valve for regulating fuel flow. Downstream of the valve is a tubular spout for directing the fuel towards or into a container. One or more of the surfaces of the tubular spout have a surface energy less than that of aluminum. The low surface energy surfaces cause the fuel to bead up rather than wet-out, as is the case with aluminum and aluminum alloys. Beading of droplets results in more drops falling into the container and less fuel to reside on the spout surfaces after fueling.

These and other features, aspects, and advantages of the present invention will become better understood with regard to the following description, appended claims, and accompanying drawings.

BRIEF DESCRIPTION OF THE DRAWINGS

Preferred embodiments of the invention are described below with the reference to the following accompanying drawings.

DETAILED DESCRIPTION OF THE PREFERRED EMBODIMENTS

Many of the fastening, connection, manufacturing and other means and components utilized in this invention are widely known and used in the field of the invention are described, and their exact nature or type is not necessary for a person of ordinary skill in the art or science to understand the invention; therefore they will not be discussed in detail.

The term "rib" as used herein includes, without limitation, any protrusion from a surface, as well as any protrusion resulting from the removal of material into the surface.

As used herein, any surface X that is later referred to as X' (prime) indicates that X has been improved, according to the present invention, to X'.

Applicant hereby incorporates by reference the following U.S. patents: U.S. Pat. No. 5,765,609; U.S. Pat. No. 5,603,364; U.S. Pat. No. 4,453,578 and U.S. Pat. No. 5,213,142.

Figure 1:
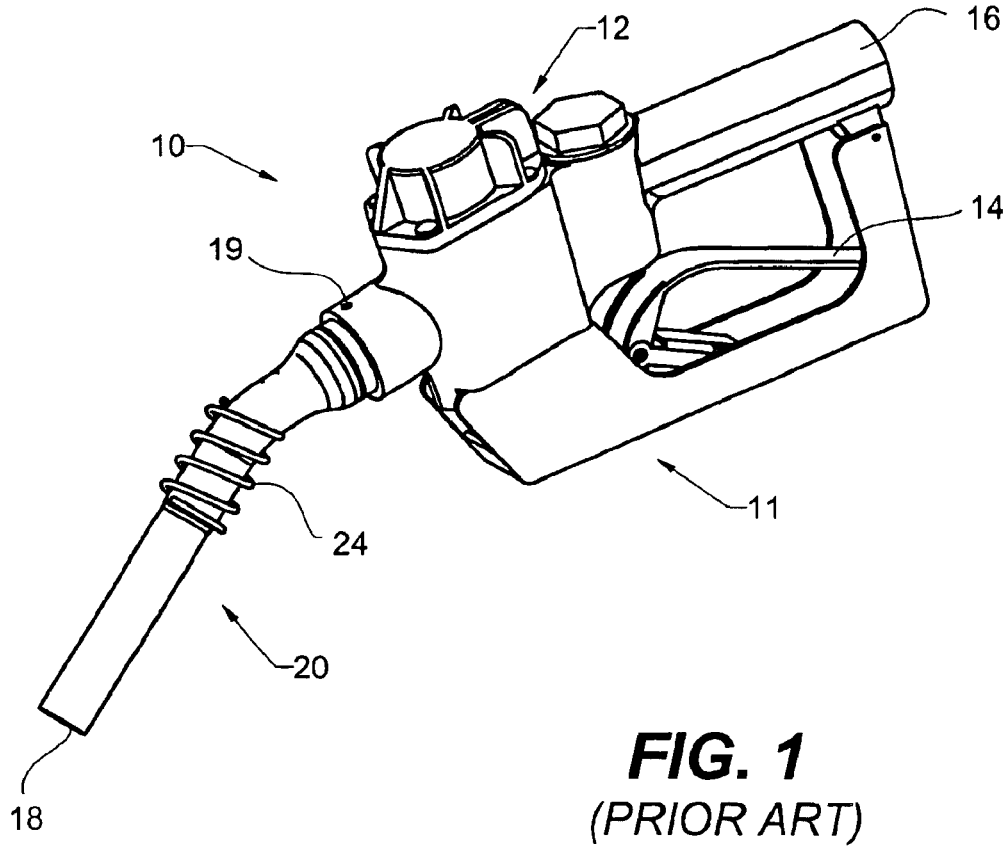
FIG. 1 (PRIOR ART)
FIG. 1 is a perspective view of a prior art standard nozzle assembly.

Referring now to the drawings, FIG. 1 shows a prior art fuel dispensing nozzle assembly 10. Nozzle assembly 10 may be used for dispensing a fuel such as, but not limited to, gasoline or diesel. Typically, nozzle assembly 10 is comprised of a nozzle body 11 which houses the components necessary for safely regulating the flow of fuel. Fuel travels from a fuel supply via a pump and hose system (not shown) to a nozzle inlet end 16, through a valve assembly 12, into a spout 20, and out a discharge end 18. Fuel flow is initiated by a user moving an actuator 14. Fuel flow typically stops due to either the user releasing actuator 14 or by valve assembly 12 sensing a full condition and automatically releasing actuator 14. Detailed descriptions of above components are described by U.S. Pat. No. 4,453,578 but are not necessary for one skilled in the art to understand and appreciate the present invention, thus they will not be discussed in further detail.

Figure 2:
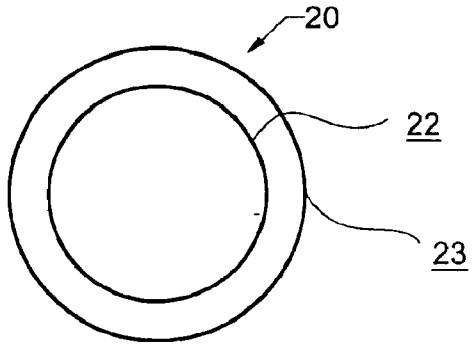
FIG. 2 (PRIOR ART)
FIG. 2 is an end view of a prior art spout.

In many fuel nozzles, spout 20 is removably attached to nozzle body 11. Spout 20 is inserted into nozzle body 11 and the assembly is secured by means of a spout screw 19 (only hole shown). Spout 20 is sealed through the use of one or more o-rings (not shown). As shown in FIG. 2, spout 20 has an inside direct contact surface 22 and an outside indirect contact surface 23. Direct contact surface 22 directs the flow of fuel from nozzle body 11 down the length of spout 20 and into the container to be filled. The length of travel from nozzle body 11 to discharge end 18 is roughly 9 inches. When spout 20 is inserted into the container to be filled, about 3.5 inches of its length (starting from end 18) is within the container. Spring 24 is placed onto spout 20 to keep the spout from being over inserted. Because spout 20 is inserted substantially within the container to be filled, not only does direct contact surface 22 wet with fuel, but indirect contact surface 23 becomes wet due to splashing within the container. During a fuel cycle and for a standard unleaded nozzle (13/16 inch diameter—non-vapor recovery) the total surface area of the nozzle in contact with the fuel is roughly 25 square inches. A diesel nozzle, with an outside diameter of 1 inch, provides substantially more.

As described by U.S. Pat. No. 5,765,609, a 6005-T5 aluminum material is viewed as an ideal choice for high volume spout production. It can be extruded, turned on a lathe, punched, bent, drilled and formed. In addition, aluminum is lightweight, relatively inexpensive compared to other lightweight materials, and provides the required rigidity and strength. Aluminum, and aluminum allows, are typically inert to the fuels they dispense and are electrically conductive. It can be easily seen why aluminum and aluminum alloys constitutes all, or nearly all, spouts in use today.

A significant drawback to the use of aluminum in spouts, and the direction of the present invention, is that aluminum causes unnecessary fuel dripping and liquid retention. Although the use of aluminum facilitates manufacturing low cost spouts, it is at the expense of releasing fuel vapors into the atmosphere. While many are designing "dripless" nozzles, the root cause has gone unsolved and unimproved.

Figure 7:
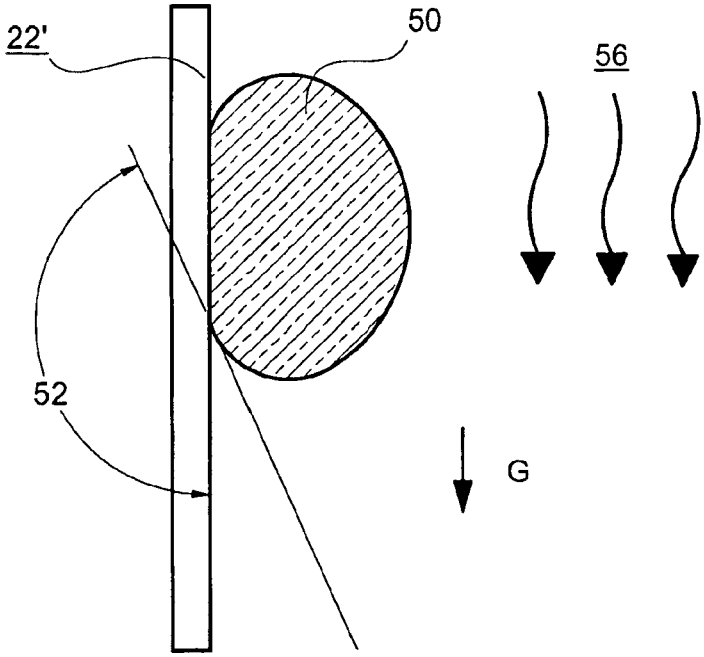

The interaction of a liquid droplet and a surface is subject to physical laws and formulas. When a drop is placed onto a surface it can either wet-out into a very thin dispersed film, or it can bead up on the surface. The determination on whether a drop will wet-out or bead up is a function of the relative difference between the surface tension of the liquid in the drop, and the surface energy of the surface on which the drop is placed. A typical bead is shown in FIG. 7, wherein a drop 50 is in direct contact with a low surface energy surface 22'. Contact angle 52 provides indication at the degree in which drop 50 is in contact with surface 22'. Contact angle 52 can be predicted by Young's Equation which states the solid-vapor interfacial tension minus the solid-liquid interfacial tension equals the liquid-vapor interfacial tension multiplied by the cosine of critical angle 52.

With a horizontal surface (not shown) drop 50 will be symmetrical. In the case of a vertical surface, drop 50 is likely to deform in the direction of gravity, as shown by the arrow marked "G". Thus, FIG. 7 is shown simplified for a vertical surface. Under the influence of gravity, drop 50 may or may not move in the direction of gravity. If drop 50 is sufficient in size and density to overcome the adhesive forces between it and surface 22', it will slide or fall. Thus, in the case of wanting drop 50 to move in the direction of gravity it is desirable to make surface 22' (also applies to surface 23') with a very low surface energy and to have drop 50 have a very high surface tension. Because fuel surface tension properties are relatively fixed, movement of drop 50 is a largely a function of surface energies.

In the case of aluminum spouts used for dispensing fuel, aluminum has a much higher surface energy than the surface tension of gasoline or diesel. Aluminum typically has a surface energy close to 45 dynes per centimeter and gasoline has a surface tension close to 21.6 dynes per centimeter. Diesel has a larger surface tension than gasoline at roughly 30 dynes per centimeter. Thus, it can easily be seen that with aluminum, a spout is easily wet-out by both gasoline and diesel. This creates a highly undesirable situation in terms of fuel drips, fuel retention, and vapors released into the atmosphere.

Figure 3:
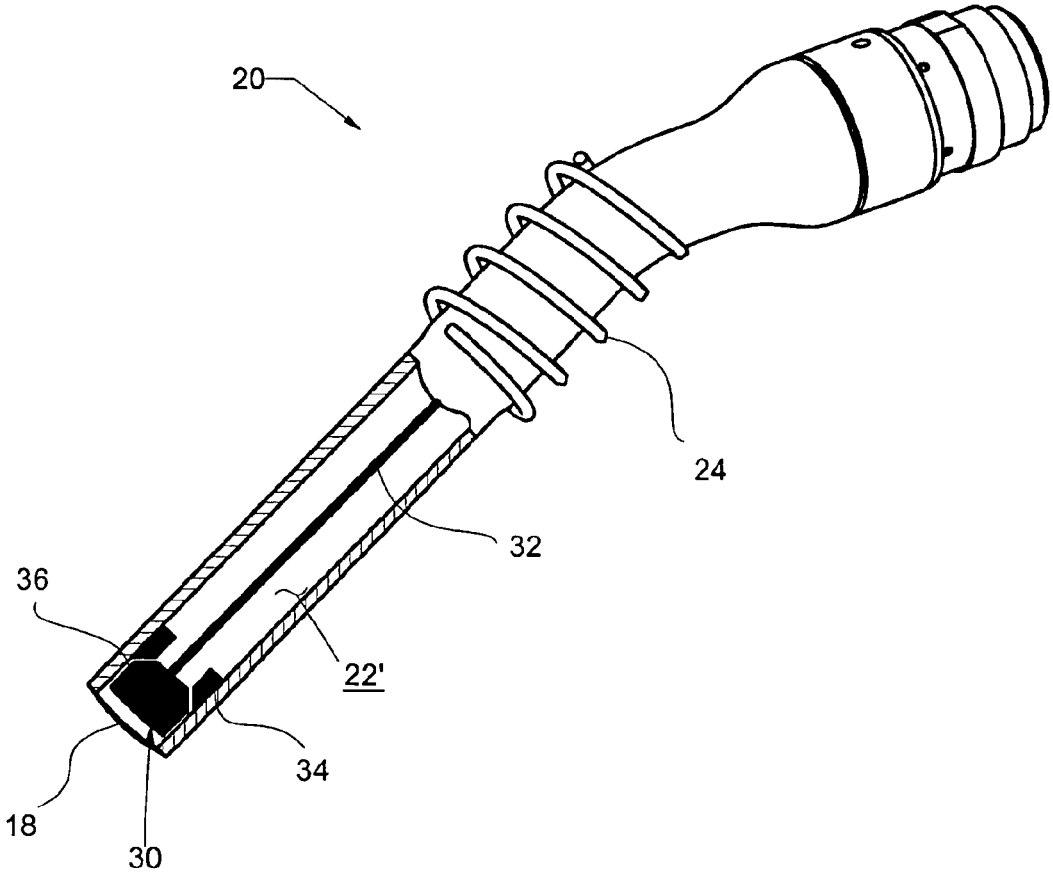
FIG. 3 is a perspective view of a nozzle spout with a cutaway to show the inside low surface energy surface of the spout, including an alternative embodiment "dripless" feature.

FIG. 3 shows both a preferred and alternative embodiment of the invention. The preferred embodiment is wherein direct contact surface 22', located within spout 20, is a low surface energy surface. Even though only a portion of direct contact surface is shown, the entire surface 22', extending from discharge end 18 to valve assembly 12, can benefit from having a low surface energy. During fueling, fuel flows as normal. When fuel flow is stopped, fuel along contact surface 22' is encouraged to bead up. By beading up, again as shown in FIG. 7, the fuel is subject to the force of gravity and momentum. Significant amounts of fuel that would otherwise be left on spout 20 drips into the container to be filled prior to the user removing spout 20. The result is more fuel dispensed into the container, less drops on the ground, and less fuel evaporating off nozzle assembly 10.

The present invention has been tested and shown to significantly reduce residual fuel on spout 20, in comparison to aluminum and other wet-able surfaces, such as an anodized aluminum, nylon, and ABS material. As a preferred embodiment of the invention, standard 6005-T5 aluminum surfaces from a commercially available OPW 11 series nozzle (a trademark of the Dover Resource Corporation) were coated with a fluoropolymer coating. PFA (perfluoroalkoxy), a member of the Teflon family (a trademark of DuPont), was chosen due to its ability to be applied at a low cost, its low surface energy (roughly 18 dynes per centimeter), its low porosity, and its chemical resistance to fuels. Using gasoline, improved inside direct contact surface 22' was shown to reduce residual fuel by roughly 33% over unimproved direct contact surface 22. Further surface treatments and surface preparations, such as removing all burrs and scratches prior to coating are likely to make an increased improvement.

Figure 4:
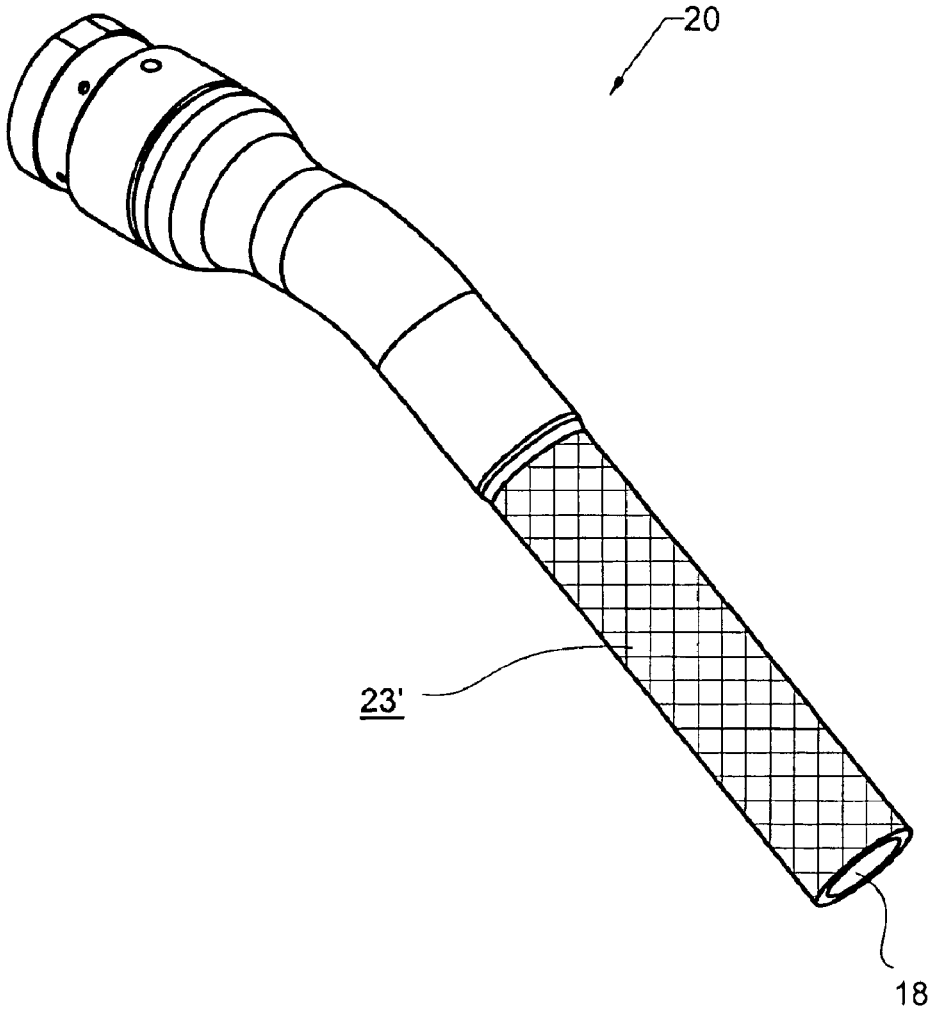
FIG. 4 is a perspective view of a nozzle according to the present invention with the outer surface having a low surface energy.

Now referring to FIG. 4, spout 20 is shown with indirect contact surface 23'. As with direct contact surface 22', indirect contact surface 23' can be coated from end 18 to valve assembly 12, however because only the first portion of spout 20 is indirectly exposed to fuel only the first portion needs to have a low surface energy. Residual fuel on surface 23' contributes to vapor emissions, creates fuel drips and is unaddressed by any "dripless" features.

Although FIG. 3 and FIG. 4 show surfaces 22' and 23' coated individually, the improvements can be combined. Testing of both surfaces together has yielded improvements up to 56% using gasoline and over 65% with diesel.

It should be appreciated that reductions of drips and residual fuel on spouts is not limited to just standard (non-vapor recovery) nozzles as shown. Although providing the means to improve the environmental performance of non-vapor recovery nozzles is a significant feature of the present invention, the present invention can be applied to vapor recovery systems and new "dripless" nozzles. Wherein vapor recovery systems and "dripless" nozzles may eliminate a pound of gasoline vapor for dollars of equipment costs, the present invention can remove a pound of vapor for pennies in cost. The present invention can be incorporated in all types of nozzles with very little cost impact.

A "dripless" spout, similar to one described by U.S. Pat. No. 5,603,364, is shown in FIG. 3 and forms the alternative embodiment previously mentioned. "Dripless" assembly 30 is located at the most downstream location possible, typically adjacent to discharge end 18. A wire 32 is attached to valve system 12, or actuator 14, and to a plunger 36. Plunger 36 is pulled against a seat 34 wherein the interaction of seat 34 and plunger 36 discourages residual fuel within spout 20 from reaching discharge end 18. A problem with "dripless" assembly 30 is it too has surface area in contact with fuel and the higher surface energy plastic or metallic materials used therein are subject to clinging fuel and resulting drips. The present invention further reduces dripping in "dripless" nozzles.

In addition to "dripless" nozzles, the present invention is applicable to balance and assist vapor recovery systems. Although a vapor assist nozzle has not been tested, the present invention is likely to improve the environmental performance of such nozzles due to the fact that vapor assist nozzles typically use coaxial spouts and added features and orifices which all increase the surface areas subject to direct or indirect contact fuel. Any of such surfaces may be improved by the present invention, including vapor recovery passages made from nylon. In addition, vapor recovery offers improved performance due to the airflow it creates. As shown in FIG. 7, an airflow 56 travels over and around drop 50. With a surface that is wet-out with fuel, as is the case with aluminum, the residual fuel is unlikely to be affected by airflow 56. In the case of fuel on a surface according to the present invention, drop 50 has a substantial critical angle which pushes drop 50 away from surface 22' and into airflow 56. The result is likely to provide an even further efficient vapor recovery system.

Even though a thin PFA coating has been disclosed as the best mode of the present invention, it is not limited to such and the present invention should not be construed to be limited to a fluorocarbon, a fluoropolymer, or a Teflon coating (trademark of Dupont). Many other materials may be applied, or used, to provide low surface energy surfaces. This includes materials which may be deposited by CVD, dipped, sprayed, and electro-statically deposited. In addition, the spout may be manufactured from a material that has a low surface energy, such as from a molding process for example. All fall within the spirit of the present invention.

Figure 5:
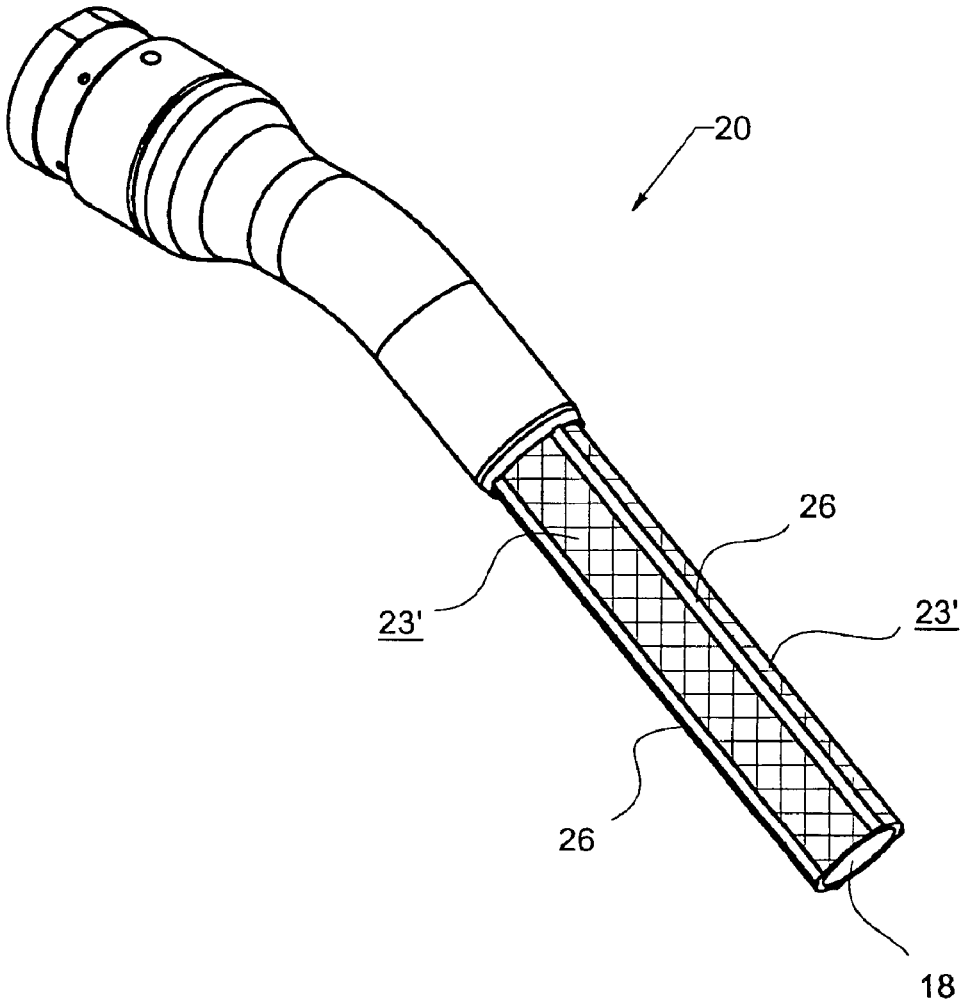
FIG. 5 is a perspective view of an alternative embodiment of the present invention with grounding and protection protrusions.
Figure 6:
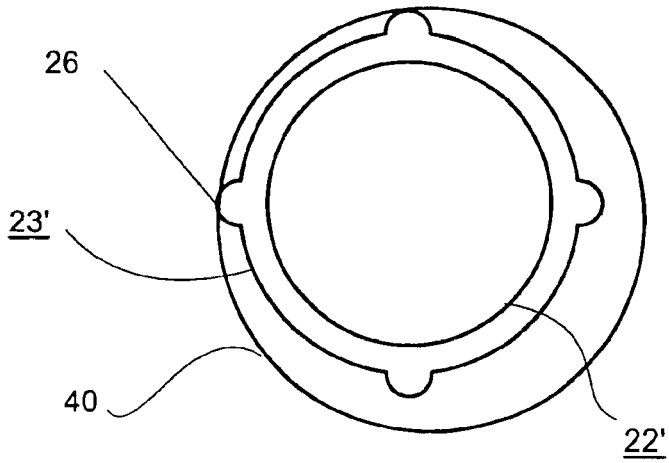
FIG. 6 is a top view of the alternative embodiment spout of FIG. 4 inserted into a typical fuel tank orifice; and, FIG. 7 is a side view of a drop of fuel on a surface of a spout with a low surface energy according to the present invention.

Since many low surface energy materials are not electrically conductive, FIG. 5 and FIG. 6 show another alternative embodiment of the present invention. When indirect contact surface 23' is non-conductive, one or more ribs 26 can be formed or attached to surface 23' which provide conductive surfaces. Ribs 26 protrude past surface 23' and ensure contact with a container inlet 40 as shown in FIG. 6. As is the case with recent attentions brought to electrostatic charges causing fuel station burn accidents, it may be desirable to have a non-conductive spout. For this case, ribs 26 should be omitted. In addition to grounding, ribs 26 can be used to protect surface 23' from wear. Although ribs 26 is shown to have 4 individual ribs, it is preferable to have at least 3.

While the low liquid retention fuel nozzle systems herein described constitute preferred embodiments of the invention, it is to be understood that the invention is not limited to these precise form of assemblies, and that changes may be made therein without departing from the scope and sprit of the invention as defined in the appended claims.

ELEMENTS BY REFERENCE NUMBER

| # | NAME |
|---|---|
| 10 | Nozzle Assembly |
| 11 | Nozzle Body |
| 12 | Valve Assembly |
| 13 | |
| 14 | Actuator |
| 15 | |
| 16 | Inlet End |
| 17 | |
| 18 | Discharge End |
| 19 | Spout Screw |
| 20 | Spout |
| 21 | |
| 22 | Direct Contact Surface |
| 23 | Indirect Contact Surface |
| 24 | Spring |
| 25 | |
| 26 | Rib |
| 27 | |

-continued

| ELEMENTS BY REFERENCE NUMBER | |
|---|---|
| # | NAME |
| 28 | |
| 29 | |
| 30 | "Dripless" Assembly |
| 31 | |
| 32 | Wire |
| 33 | |
| 34 | Seat |
| 35 | |
| 36 | Plunger |
| 37 | |
| 38 | |
| 39 | |
| 40 | Container Inlet |
| 41 | |
| 42 | |
| 43 | |
| 44 | |
| 45 | |
| 46 | |
| 47 | |
| 48 | |
| 49 | |
| 50 | Droplet |
| 51 | |
| 52 | Contact Angle |
| 53 | |
| 54 | |
| 55 | |
| 56 | Airflow |
| 57 | |
| 58 | |
| 59 | |
| 60 | |
| 61 | |
| 62 | |
| 63 | |
| 64 | |
| 65 | |
| 66 | |
| 67 | |
| 68 | |
| 69 | |
| 70 | |
| 71 | |
| 72 | |
| 73 | |
| 74 | |
| 75 | |
| 76 | |
| 77 | |
| 78 | |
| 79 | |

What is claimed is:

1. A low liquid retention fuel dispensing nozzle comprising:

a generally tubular spout attached to said nozzle for directing a fuel supply from a valve within said nozzle to a discharge end of said spout, said supply of fuel having a surface tension;

a first surface of said spout in direct contact with said fuel supply;

a second surface of said spout that may be in indirect contact with said fuel supply; and, wherein said first surface or said second surface has a surface energy less than said surface tension of said supply of fuel.

2. A fuel dispensing nozzle as recited in claim 1, wherein said first surface or said second surface is made from a material of the fluoropolymer family.

3. A fuel dispensing nozzle as recited in claim 1, wherein said first surface includes an assembly for reducing drips.

4. A fuel dispensing nozzle as recited in claim 1, wherein said spout is configured as a vapor recovery spout.

5. A fuel dispensing nozzle as recited in claim 1, wherein said second surface has 3 or more ribs.

6. A fuel dispensing nozzle as recited in claim 1, wherein said second surface is electrically insulating.

7. A low liquid retention fuel dispensing nozzle comprising:

a generally tubular spout attached to said nozzle, said spout having a first end for receiving a fuel supply from said nozzle and a second end for dispensing said fuel supply;

an inside surface of said spout for directing said fuel from said first end to said second end of said spout;

an outside surface of said spout, wherein said outside surface may be in indirect contact with said fuel supply; and, wherein said inside surface or said outside surface of said spout has a surface energy less than 30 dynes per centimeter.

8. A fuel dispensing nozzle as recited in claim 7, wherein said inside surface or said outside surface is made from a material of the fluoropolymer family.

9. A fuel dispensing nozzle as recited in claim 7, wherein said inside surface includes an assembly for reducing drips.

10. A fuel dispensing nozzle as recited in claim 7, wherein said spout is configured for vapor recovery.

11. A fuel dispensing nozzle as recited in claim 7, wherein said outside surface of said spout contains 3 or more ribs.

12. A fuel dispensing nozzle as recited in claim 7, wherein said spout is removably attached to said nozzle.

13. A method of reducing fuel retention on a generally tubular fuel dispensing spout, the method comprising: manufacturing one or more surfaces of said spout to have a surface energy less than 30 dynes per centimeter.

14. The method of claim 13, wherein said spout includes surfaces for reducing drips from said spout.

15. The method of claim 13, wherein said spout includes one or more vapor recovery channels.

16. The method of claim 13, wherein said surfaces are applied by a coating process.

17. The method of claim 13, wherein one or more of surfaces is electrically insulating.

18. The method of claim 13, wherein said spout is constructed in whole from low surface energy material.

19. The method of claim 13, wherein said spout has 3 or more protective ribs.

20. The method of claim 13, wherein said one or more surfaces is made of a material from the fluoropolymer family.

21. A fuel dispensing apparatus, comprising:

a generally tubular spout fabricated from a rigid material having a first end for receiving a supply of fuel and a second end for discharging said supply of fuel;

said spout having a wall connecting said first end and said second end; and, wherein at least a portion of said wall is coated with a low surface energy material capable of creating a non-wetting condition with said fuel.

22. A fuel dispensing apparatus as recited in claim 21, wherein said spout is configured as a vapor recovery spout.

23. A fuel dispensing apparatus as recited in claim 21, wherein said spout includes an assembly for reducing drips.

* * * * *